US006452317B1

(12) United States Patent
Tseng

(10) Patent No.: US 6,452,317 B1
(45) Date of Patent: Sep. 17, 2002

(54) DECORATIVE LIGHT

(76) Inventor: Jeou-Nan Tseng, No. 539, Sec. 4, Chunghua Rd., Hsinchu (TW)

( * ) Notice: Subject to any disclaimer, the term of this patent is extended or adjusted under 35 U.S.C. 154(b) by 0 days.

(21) Appl. No.: 09/546,279

(22) Filed: Apr. 10, 2000

(51) Int. Cl.[7] ..... H01J 5/50; H01R 33/00
(52) U.S. Cl. ..... 313/318.01; 362/226; 439/699.2
(58) Field of Search ..... 313/318.01, 318.09; 362/226, 249; 439/699.1, 699.2, 602

(56) References Cited

U.S. PATENT DOCUMENTS 5,810,621 A * 9/1998 Tsai ..... 439/619
5,915,826 A * 6/1999 Lin ..... 362/226
6,109,764 A * 8/2000 Shu ..... 362/226

* cited by examiner

*Primary Examiner*—Ashok Patel
*Assistant Examiner*—Thelma Sheree Clove
(74) *Attorney, Agent, or Firm*—Thomas, Kayden, Horstemeyer & Risley LLP

(57) ABSTRACT

A decorative light with an LED as the light source has a socket, two protrusions integrally formed on the inner face of the socket, a base detachably inserted into the socket, an LED mounted on the base, two projections integrally formed on the base for two electrodes of the LED to extend therethrough respectively and two electric wires inserted into second end of the socket, wherein the distances between the end of the socket and each of the protrusions are different from each other, in addition the lengths of each of the projections are different from each other. So that, each electrode of the LED will touch each corresponding wire only in a specific orientation. This can keep the LED from being burned out due to the incorrect connection of the electrodes between the LED and the electric power, and decrease the cost of manufacturing the decorative light with the LED as the light source.

4 Claims, 2 Drawing Sheets

DECORATIVE LIGHT

BACKGROUND OF THE INVENTION

1. Field of the Invention

The present invention relates to a decorative light, and more particularly to a decorative light with an LED as the light source.

2. Description of Related Art

The decorative light is an important decoration during the Christmas season. The conventional decorative light in accordance with the prior art comprises a socket, a base inserted into the socket and a bulb mounted in the base. Two electric wires are inserted into the socket and electrically connect to the two electrodes of the bulb to provide electricity to the bulb. Multiple decorative lights are strung together by electric wires to form a decorative light set. The decorative light set can be easily attached to a Christmas tree, a post or the like to increase the aesthetic appearance of the body to which the Christmas light set is attached.

However, because the power consumption of the bulbs is very large, the conventional Christmas light set will cost a lot of money when used for extended periods of time. Thus a Christmas light with an LED as the light source instead of the conventional bulb is provided to reduce the power consumption of the Christmas light set.

However, the electrodes of an LED connected with the electric power must be correct and cannot be changed arbitrarily. Specifically, when the anode of the LED is connected with the cathode of the electric power and the cathode of the LED is connected with the anode of the power, the LED will not light. The LED will burn out due to the incorrect connection of the electrodes. In addition, the conventional socket and base do not have any means to ensure that an LED is only inserted with the correct orientation. This will increase the difficulty and the cost of manufacturing the LED Christmas light.

To overcome the shortcomings, the present invention tends to provide an improved Christmas light to mitigate or obviate the aforementioned problems.

SUMMARY OF THE INVENTION

The main objective of the invention is to provide an improved Christmas light having a socket, a base detachably inserted into the socket, an LED mounted on the base and two electric wires extending into the socket. Two protrusions are integrally formed on the inner face of the socket, and a projection is integrally formed on the base and corresponds to each protrusion. The distances between said first end of said socket and each of said protrusions are different, and the length of each of said projections are different, so that the orientation of the electrodes between the LED and the electric power is correct. This can keep the LED from burning out due to incorrect connection between the electrodes.

Other objects, advantages and novel features of the invention will become more apparent from the following detailed description when taken in conjunction with the accompanying drawings.

DETAILED DESCRIPTION OF PREFERRED EMBODIMENT

Figure 1:
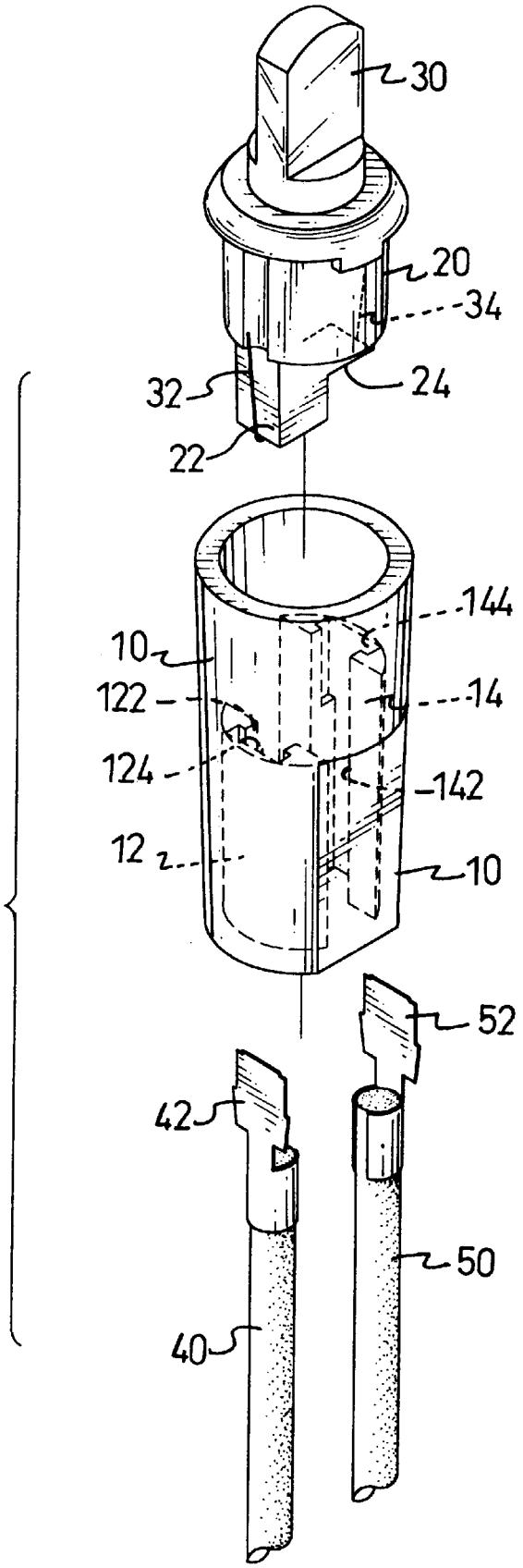
FIG. 1 is an exploded perspective view of a Christmas light with an LED as the light source in accordance with the present invention.
Figure 2:
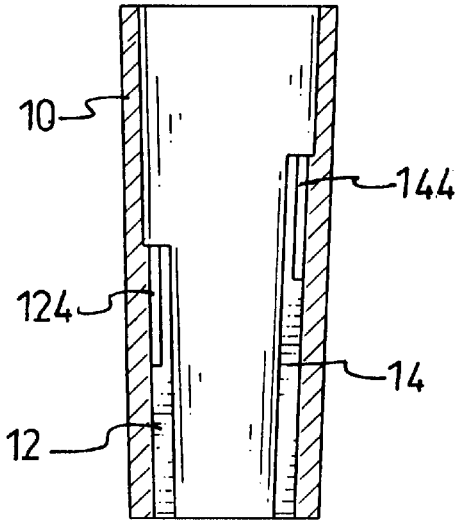
FIG. 2 is a side plan view in partial section of the socket in FIG. 1.

Referring to FIGS. 1 and 2, a Christmas light in accordance with the present invention comprises a socket (10), a base (20) inserted in the socket (10), an LED (30) mounted on the base (20) and two electric wires (40, 50) inserted into the socket (10). The base (20) is mounted in one end of the socket (10) and the wires (40, 50) are inserted into the other end. Two protrusions (12, 14) are integrally formed on the inner face of the socket (10). A groove (122, 142) is defined in the face of each protrusion (12,14) facing each other to receive a corresponding wire (40, 50). A recess (124, 144) is defined in the end of each protrusion (12, 14) toward the end of the socket (10) that receives the base (20) and communicates with the groove (122, 142). A contact (42, 52) is mounted on the end of each electric wire (40, 50) and is securely mounted in the corresponding recess (124, 144). In addition, the distances between the end of the socket (10) holding the base (20) and each of the protrusions (12, 14) are different, such that the position of each contact (42, 52) is different relative to the other. Therefore, the anode and the cathode of the electric power can be arranged to connect with the desired one of the two wires (40,50). For example, the anode of the power supply can be connected to the electric wire (40) with contact (42) mounted on the protrusion (12) farthest from the end of the socket (10) holding the base (20), and the cathode of the power can be connected to the wire (50) mounted on the other protrusion (14).

Projections (22, 24) are integrally formed on the bottom of the base (20) corresponding to the protrusions (12, 14) in the socket (10). Each projection (12,14) has a different length, i.e. the length of the projection (22) corresponding to the protrusion (12) farthest from the end of the socket (10) holding the base (20) is longer than the projection (24) corresponding to the protrusion (14) nearer the end of the socket (10) holding the base (20). The LED (30) has an electrode (32, 34) extending through each of the projections (22, 24) and bent around the bottom of each corresponding projection (22, 24). Thus, the end of each electrode (32, 34) of the LED (30) is located at a different position from the other. Consequently, the anode and the cathode of the LED (30) can be arranged to correspond to the electrodes of the electric power.

Figure 3:
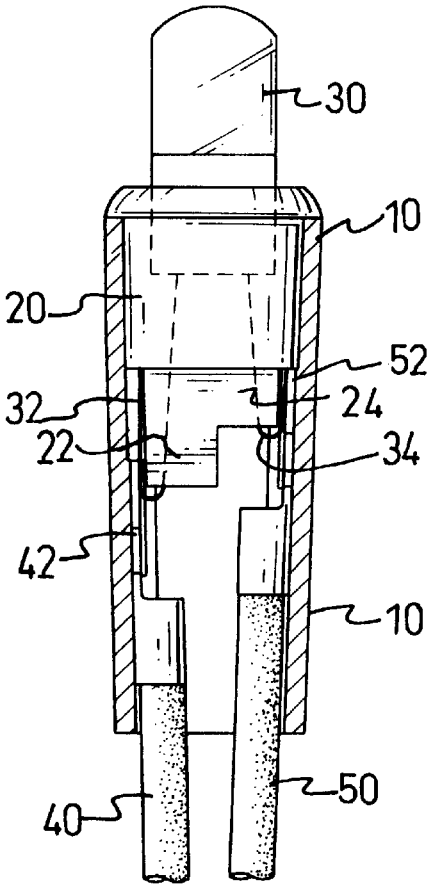
FIG. 3 is a side plan view in partial section of the Christmas light in FIG. 1 showing the correct connection between the LED and the two electric wires.

With reference to FIGS. 1 and 3, when the base (20) is inserted into the socket (10) with the correct orientation, each electrode (32, 34) of the LED (30) touch the corresponding contact (42, 52) on the appropriate wire (40, 50). The electrodes of the LED (30) will correctly connect with the electrodes of the electric power by the arrangement of the protrusions (12, 14) and the projections (22, 24). Consequently, the electric power will be transmitted to the LED (30) through the wires (40, 50), and the Christmas light will operate in properly.

Figure 4:
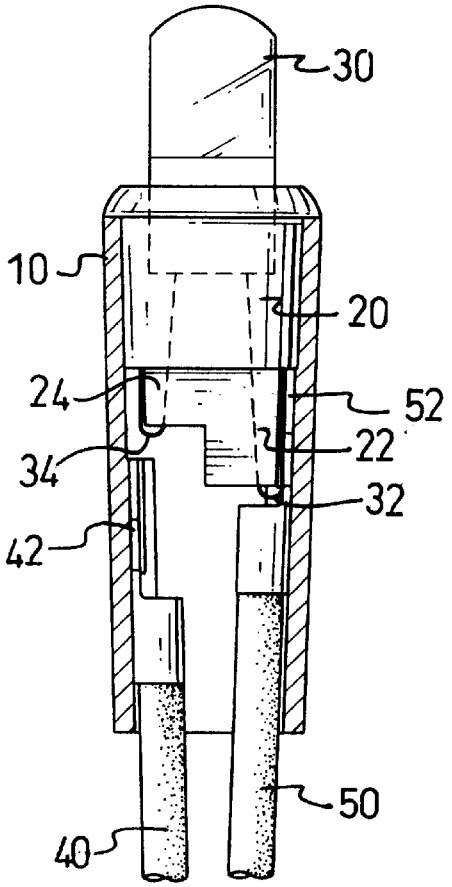
FIG. 4 is side plan view in partial section of the Christmas light in FIG. 1 showing the incorrect orientation between the LED and the two electric wires.

Referring to FIGS. 1 and 4, when the base (20) inserted into the socket (10) with the incorrect orientation, the shorter projection (24) corresponds to the protrusion (12) farthest from the end of the socket (10) holding the base (20) and the longer projection (22) corresponds to the other protrusion (14). The electrode (34) of the LED (30) extending through the shorter projection (24) will not touch the contact (42) mounted on the protrusion (12) farthest from the end of the socket (10) holding the base (20). Consequently, the circuit through the LED (30) will not be completed through the wires (40, 50), and the electric power will not be transmitted to the LED (30) when the power is turned on. The LED (30) will not burn out due to incorrect connection of the electrodes. The Christmas light will operate properly after the orientation of the base (20) is corrected. This provides a means of protective to the Christmas light with an LED (30) as the light source, and avoid damage to the LED (30) in addition to decreasing the cost of manufacturing the Christmas light.

Even though numerous characteristics and advantages of the present invention have been set forth in the foregoing description, together with details of the structure and function of the invention, the disclosure is illustrative only, and changes may be made in the details, especially in matters of shape, size, and arrangement of parts within the principles of the invention to the full extent indicated by the broad general meaning of the terms in which the appended claims are expressed.

What is claimed is:

1. A decorative light comprising:

a socket having a first end and a second end;

two protrusions integrally and oppositely formed on an inner face of said socket, each protrusion having a length different from the other;

a base detachably inserted into said first end of said socket and having two projections integrally formed on a bottom of said base, each projection facing one of said protrusions and having a length different from the other;

an LED mounted in said base and having an electrode extending through each said projection; and two electric wires inserted into said second end of said socket, each having a contact securely attached on each said protrusion and spaced from said first end of said socket a different distance;

wherein the distances between said first end of said socket and the ends of each of said protrusions are different, such that each electrode leg will touch only the corresponding contact in a desired direction so as to avoid wrong contact occurring between the electrode leg of the LED and the electric wires.

2. The decorative light as claimed in claim 1, wherein a groove is defined in a side of each protrusion to receive one of said electric wires therein.

3. The decorative light as claimed in claim 2, wherein the recess is defined in each said protrusion end which faces said first end f said socket to securely attach each said contact of said corresponding wire therein.

4. The decorative light as claimed in claim 1, wherein the projection facing said protrusion farthest from said first end of said socket is longer than the projection facing said protrusion nearest to said first end of said socket.

* * * * *